US006601827B1

(12) United States Patent
Arzouman

(10) Patent No.: US 6,601,827 B1
(45) Date of Patent: Aug. 5, 2003

(54) ECONOMICAL LIFTING DEVICE-TRUNK JACK

(76) Inventor: Harry H. Arzouman, 26 Mainsail Dr., Corona Del Mar, CA (US) 92625

( * ) Notice: Subject to any disclaimer, the term of this patent is extended or adjusted under 35 U.S.C. 154(b) by 0 days.

(21) Appl. No.: 10/154,067

(22) Filed: May 23, 2002

(51) Int. Cl.[7] ..... B66F 3/00

(52) U.S. Cl. ..... 254/126; 254/7 B; 254/8 B; 254/89 R

(58) Field of Search ..... 254/7 B, 8 B, 254/126, 89 R, 131, 133, 134, 92, 98, 84, DIG. 1, DIG. 4, 102, 108; 403/324, 326; 7/85; 74/424.7, 533; 414/427; 248/354.7

(56) References Cited

U.S. PATENT DOCUMENTS

| | | | | | |
|---|---|---|---|---|---|
| 2,469,048 | A | * | 5/1949 | Manke | 254/126 |
| 2,546,361 | A | * | 3/1951 | Floyd | 254/126 |
| 3,746,307 | A | * | 7/1973 | Yamazaki | 254/126 |
| 3,938,780 | A | * | 2/1976 | Hauptman | 254/126 |
| 4,025,053 | A | * | 5/1977 | Stickle | 254/122 |
| 4,462,569 | A | * | 7/1984 | Arzouman | 254/8 B |
| 4,589,630 | A | * | 5/1986 | Arzouman | 254/7 B |
| 4,641,813 | A | * | 2/1987 | Arzouman | 254/8 B |
| 5,065,983 | A | * | 11/1991 | Slay | 254/8 B |

* cited by examiner

*Primary Examiner*—Joseph J. Hail, III
*Assistant Examiner*—Daniel Shanley
(74) *Attorney, Agent, or Firm*—Roger C. Turner

(57) ABSTRACT

The specification describes economical lifting devices. A consumer jack comprising a rectangular base; a pair of connecting arms that are pivotally attached to the front end of the base, and a pair of lift arms that are attached to the connecting arms and attached at the rearward ends thereof to a sliding block. A screw-threaded actuator shaft is engaged with the sliding block to raise and lower a lifting pad attached to the forward ends of the lift arms of the device. The components are stamped from steel sheet and plate, and folded into the desired configuration, and assembled without the need for machining or welding.

An economical power unit, for use with an economical jack stand and also for use with a lift bridge, comprises an adaptation of the consumer jack. The power unit does not use the lifting pad, but rather utilizes a pair of separated leveling pads pivotally attached to the forward ends of the lift arm for engagement with a lift collar of the jack stand. The power unit further features a slide forward bridge for use (without the jack stand) directly as a lifting device.

An economical jack stand for use with the power unit is similarly formed from steel sheet and plate comprising a base plate, tubular housing extending upward from the plate, and a telescopic U shaped ratchet shaft extendable from within the housing. A pair of pawls can be engaged to lock the ratchet shaft in position within the housing.

8 Claims, 8 Drawing Sheets

ECONOMICAL LIFTING DEVICE-TRUNK JACK

CROSS REFERENCE TO RELATED APPLICATIONS

Applications have also been filed directed to an Economical Lifting Device—Power Unit For Use With a Jack Stand and Lift Bridge, and an Economical Lifting Device—Jack Stand, as described in the present specification.

BACKGROUND OF THE INVENTION

The invention relates to a low cost consumer device for lifting and supporting an object i.e. a corner of an automobile; particularly to a low cost consumer jack, and also to a low cost two part jacking system including a power unit that can be used to place and elevate a jack stand. The inventor of the present invention is a pioneer of the two part jacking system holding numerous issued and pending patents for a two part jacking system and related products and processes as described below. All such prior art patents and applications are incorporated herein by reference.

Briefly, the commercial two part jacking system consists of a power unit and a set of separate mechanical jack stands. Examples of the two part jacking system and mobile power unit are described in detail in U.S. Pat. Nos. Re. 32,715 and 4,589,630. Some examples of the jack stands are described in detail in U.S. Pat. Nos. 4,553,772; 4,490,264; 5,110,089; 5,183,235 and 5,379,974. The stands are capable of being vertically extended and retracted from the garage floor or road surface and, when extended, can be locked in place at any desired position by a ratchet and pawl assembly. The commercial power unit has a mobile chassis adapted to carry a plurality of the jack stands, and has a pair of lift arms adapted to mate with the outermost jack stand for placement and removal.

In use, the commercial mobile power unit is operated entirely from its handle. It is maneuvered under a vehicle to place a jack stand in a desired location for lift and supporting the vehicle. The power unit is activated from the handle, and this jack stand is then vertically extended to the desired height, thus lift the vehicle on the stand. By operating the controls at the end of the handle, the operator can cause the power unit to disengage from the stand, and the stand will remain locked in its extended supporting position under the vehicle. After the stand is raised and locked in place to support the vehicle or other load in a lifted position, the power unit lift arms are lowered and the power unit is disengaged from the stand and pulled away, leaving the stand in position supporting the load. Another jack stand, carried within the chassis, is automatically transferred to the forward end the chassis for placement at another desired location of the vehicle or for use to lift and support another vehicle.

To lower the vehicle and remove the stand, the power unit is maneuvered to reengage with the stand. The engagement causes any existing jack stands carried within the chassis to be automatically transferred rearward within the chassis. By manually operating a control at the end of the handle, the operator can cause the power unit to reengage with the stand, and to disengage the ratchet locking mechanism of the stand and lower the stand to its original position. The power unit remains engaged with the stand and can be pulled away from the vehicle with the stand carried within the chassis.

The original commercial power units were adapted to carry up to four jack stands within the chassis. Additional jack stands could be purchased and arranged at various stations on the garage floor to reload the power unit, so that a single power unit could be utilized to efficiently place and actuate numerous jack stands. It was found that many commercial users would utilize all of their available jack stands, and the power unit was thereafter useless until another jack stand was available to be extracted and reused. The present inventor developed a slide forward bridge that adapted the power unit to function as a load-lifting jack to more fully utilize the power unit. Co-pending patent applications have been filed on the features of the power unit convertible into a load-lifting device.

Most of the prior art lifting devices, including those of the present inventor, are very rugged "commercial quality" products involving many castings and machined parts that require welding for fabrication and assembly. It would be highly desirable to design and develop the innovative jack systems in a low cost "consumer quality" configuration that involved minimal welding and machining during fabrication and assembly.

In view of the foregoing problems and desirable features of a two part lift and supporting system, it is an object of the present invention to provide a consumer jack and a consumer power unit for use with a consumer jack stand, that can be economically fabricated from sheet metal and steel plate with little or no machining, and can be assembled with little or no welding.

SUMMARY OF THE INVENTION

The foregoing objects are accomplished by an economical lifting device including a base having a rectangular bottom with a forward end and a rearward end, a rear flange extending upward from the bottom and having a central aperture therein, and side flanges extending upward from the bottom. Each side flange has an aperture near the forward end of the flange, and has an increased thickness along the upper portion providing a longitudinal recess formed along the lower portion on the inner surfaces of the flange The device includes a screw threaded actuator shaft having a distal end and a proximal end extending through the aperture of the rear flange of the base, with the proximal end rotatably retained within the aperture. The proximal end is further adapted to be engaged by an external handle to facilitate rotation of the shaft. The actuator shaft functions with a sliding block having a rectangular bottom, a forward end, rearward end, and sides that are slideably retained within the longitudinal recesses of the side flanges of the base. The block has a central threaded aperture extending through the forward and rearward ends thereof for receiving the forward end of the threaded actuator shaft.

The device further includes a pair of lift arms acting in parallel having forward ends and rearward ends with the rearward ends pivotally attached to the respective side of the block. The lift arms are connected by a pair of connecting arms, acting in parallel having forward ends pivotally attached at the apertures near the forward ends of the side flanges of the base, and having rearward ends pivotally attached at a pivot point on the lift arms. The pivot point is at a distance from the rearward end of the lift arm that is about equal to the length of the connecting arm, so that the forward end of the lift arms is elevated vertically.

A lifting pad is attached to the forward ends of said lift arms for engaging the load to be lifted; whereby, if the threaded actuator is rotated clockwise, the block advances to rotates the rearward end of the connecting arm upward and the lift arms are pivoted about the pivot point to elevate the lifting pad vertically over the forward end of the base. The lifting pad further includes a screw-out saddle for adjusting the effective height, and leveling means to maintain the lifting pad in a horizontal orientation during operation.

The major components of the lifting device can be suitably formed from standard sheet metal and metal plate stock with minimal machining and welding required to form or assemble the components. The base is formed from a piece of sheet metal having a flat pattern defining the rectangular bottom and the respective rear flange, side flanges, and additional flanges, all extending outward from the rectangular bottom. The entire base can be formed from a single piece of sheet metal that is stamped to form the apertures and the periphery defined by the flat pattern; the flat pattern is progressively folded and formed into the base without the need for welding. The block and lifting pad are similarly formed from flat patterns that are readily stamped and folded into the desired configurations without the need for machining and welding.

BRIEF DESCRIPTION OF THE DRAWINGS

While the novel features of the invention are set forth in the appended claims, the invention will be better understood along with other features thereof from the following detailed description taken in conjunction with the drawings, in which:

DETAILED DESCRIPTION OF THE INVENTION

The economical jack and support systems were conceived for consumer use, and does not incorporate a mobile chassis having wheels or a large handle for maneuvering and operating the system on a daily commercial basis, but rather as a jacking and supporting system that is placed in position for occasional use by a consumer. However, the economical manufacturing processes can be adapted for components and assemblies of commercial products, as well as the consumer products described in the following preferred embodiments. The manufacturing concepts were based upon eliminating the need for expensive machining, castings, and welding; however, the design can advantageously incorporate such processes for unique components and at critical joints without departing from the basic concepts.

Trunk Jack

Figure 1:
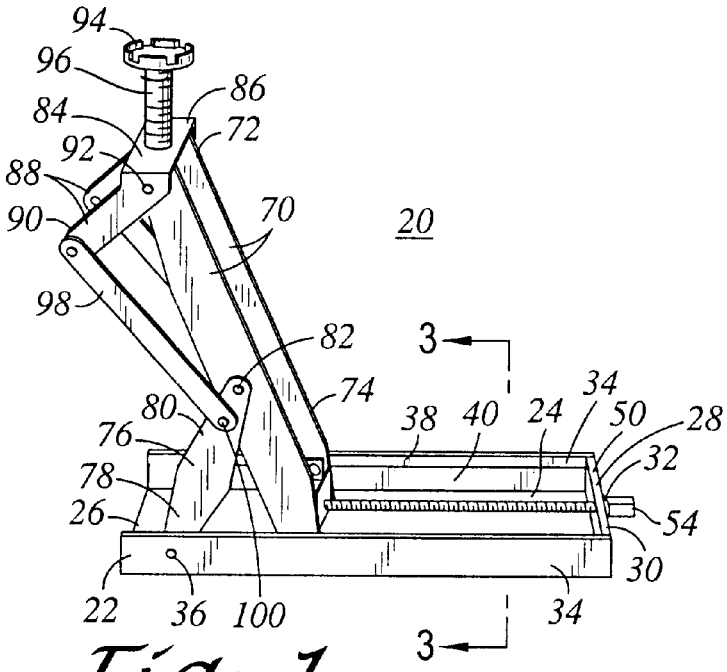
FIG. 1 is perspective view of an economical jack in an elevated position.
Figure 2:
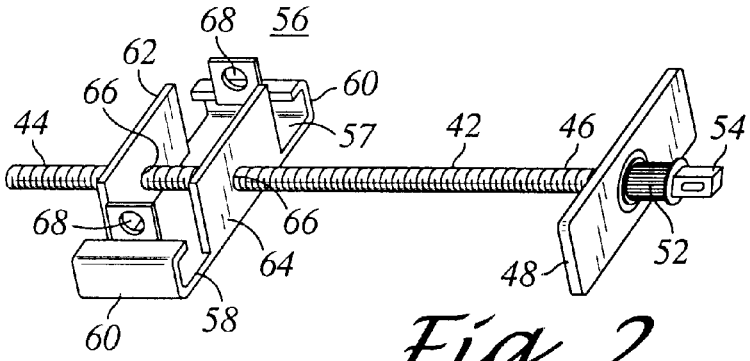
FIG. 2 is a perspective view of the screw-threaded actuator shaft and sliding block of the jack of FIG. 1.
Figure 3:
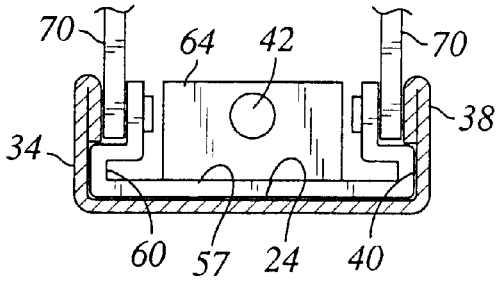
FIG. 3 is a sectional view taken along 3—3 of FIG. 1.

Referring to FIGS. 1–3, a preferred embodiment of an economical lifting device, i.e., consumer automotive trunk jack 20, is shown having components that are fabricated primarily from sheet metal and metal plate, stamped into a flat pattern that is folded or otherwise formed into the desired configuration, without the need for machining or welding. The jack has a base 22 having a rectangular bottom 24 with a forward end 26 and a rearward end 28. The base has a rear flange 30 extending upward from the bottom and has a central aperture 32. The base has side flanges 34 extending upward from the bottom, with each side flange having a reinforced aperture 36 near the forward end and having an increased thickness 38 along the upper portion of the flange providing a longitudinal recess 40 formed along the lower portion on the inner surfaces of the flange.

The base is suitably about 14 inches in length, about four inches in width with the side and rear flanges about 1.5 inches in height, and can be formed of sheet steel having a thickness of about 0.06-inch from a flat pattern that is stamped and folded as discussed later in detail.

The jack is operated by a screw threaded actuator shaft 42 (see FIG. 2) having a distal end 44 and a proximal end 46 extending through the aperture 32 of the rear flange 30. A suitable actuator is a steel shaft about eight inches in length, with a diameter of about one-half inch having machine threads formed along the length of the shaft.

A reinforcing plate 48, conforming to the shape of the rear flange 30 (about four inches by one and one-half inches) and having a central aperture, is incorporated to support and distribute the lifting forces of the actuator shaft to the flanges of the base. The reinforcing plate can be suitably formed from about 0.125-inch steel plate. In another embodiment, such reinforcement can be provided by additional folded thicknesses of the rear flange; however, for initial production, the reinforcement plate is provided to ensure durability of the device. The reinforcement plate is suitably retained within the base 22 by an inverted "U" shaped flange 50 at the upper edge of the rear flange. The proximal end 48 of the shaft is rotatably retained within the plate and aperture 32 of the rear flange by a bushing 52, and is further adapted at the proximal tip 54 to be engagable by an external handle to facilitate rotation of the shaft.

The shaft 42 actuates a sliding block 56 having a rectangular bottom 57 that slides along the bottom of the base 22. The block has side flanges 58 with lower portions 60 slideably retained within the longitudinal recesses 40 of the side flanges 34 of the base. The block has a forward flange 62 and a rearward flange 64, each having aligned apertures 66 that are threaded to provide a central threaded aperture for receiving the distal end of the threaded actuator shaft. The side flanges are further adapted with apertures 68 for attachment to the lifting mechanism of the jack. The block can be formed from a solid block of metal that is machined, drilled and threaded to provide the desired features, but is preferable formed from 0.188-sheet metal that is stamped into a flat pattern and folded and formed as described later in more detail.

The jack has a pair of lift arms 70 acting in parallel having forward ends 72 and rearward ends 74, with the rearward ends having apertures therein and pivotally attached at the apertures 68 to the respective side flanges 58 of the sliding block 56. The lift arms are suitably formed from 0.125-inch steel about 1 inch wide and about 13 inches in length. The lift arms can be produced in large quantity and received directly from the steel mill having the desired dimensions.

The lift arms 70 function with a pair of connecting arms 76 acting in parallel having forward ends 78 pivotally attached at the apertures 36 near the forward ends of the side flanges 34 of the base, and having rearward ends 80 pivotally attached to the respective lift arm at a pivot point 82. The pivot point is at a distance from the rearward end of the lift arm that is about equal to the length of the connecting arm. The connecting arms are suitably formed from 0.125-inch steel about 1 inch wide and about 5 inches in length, and can also be produced and received in large quantities directly from the steel mill.

As the block 56 is advanced by the actuator shaft 42, the rearward ends of the connecting arms are rotated upward, and the lift arms are rotated about the pivot point 82 at the rearward ends of the connecting arms, to elevate the forward ends of the lift arms vertically above the forward end 26 of the base 22.

The lift arms 70 further include a lifting pad 84 mounted on the forward ends 72 to engage the object to be lifted. The lifting pad includes an upper rectangular plate 86 oriented horizontally and having a pair of parallel lever arms 88 extending downward and forward from the sides of the plate, at an angle of about 30 degrees, with each lever arm having a lower end 90 and having an upper end 92 pivotally attached to the forward ends of the lift arms. The lifting pad is suitably formed from steel about 0.188-inch thick, with the upper plate about 1.5 inches by 4 inches, with the lever arms about 0.5-inch by 3 inches; and is produced from a stamped flat pattern (see FIG. 6) with the lever arms folded downward 90 degrees. The lifting pad preferably includes a central threaded aperture 93 for receiving a screw-out saddle 94; or the plate can utilize a sleeved nut (not shown) swedged within the aperture for alternative threaded support for the saddle.

The screw-out saddle 94 includes a threaded shaft 96 about 0.5-inch in diameter and extending downward about 4 inches, and engaged within the aperture 93 of the lifting pad. The screw-out saddle is utilized to adjust the distance between the lifting pad and the object to be lifted for maximum lift and utility of the jack.

The upper plate 86 of the lifting pad 84 is retained in the horizontal orientation by a pairs of connecting links 98 pivotally connected to the lower ends 90 of the lever arms 88 and pivotally connected to a point 100 on the connecting arms, so that the lifting pad remains substantially horizontal during movement of the lift arms.

Figure 4:
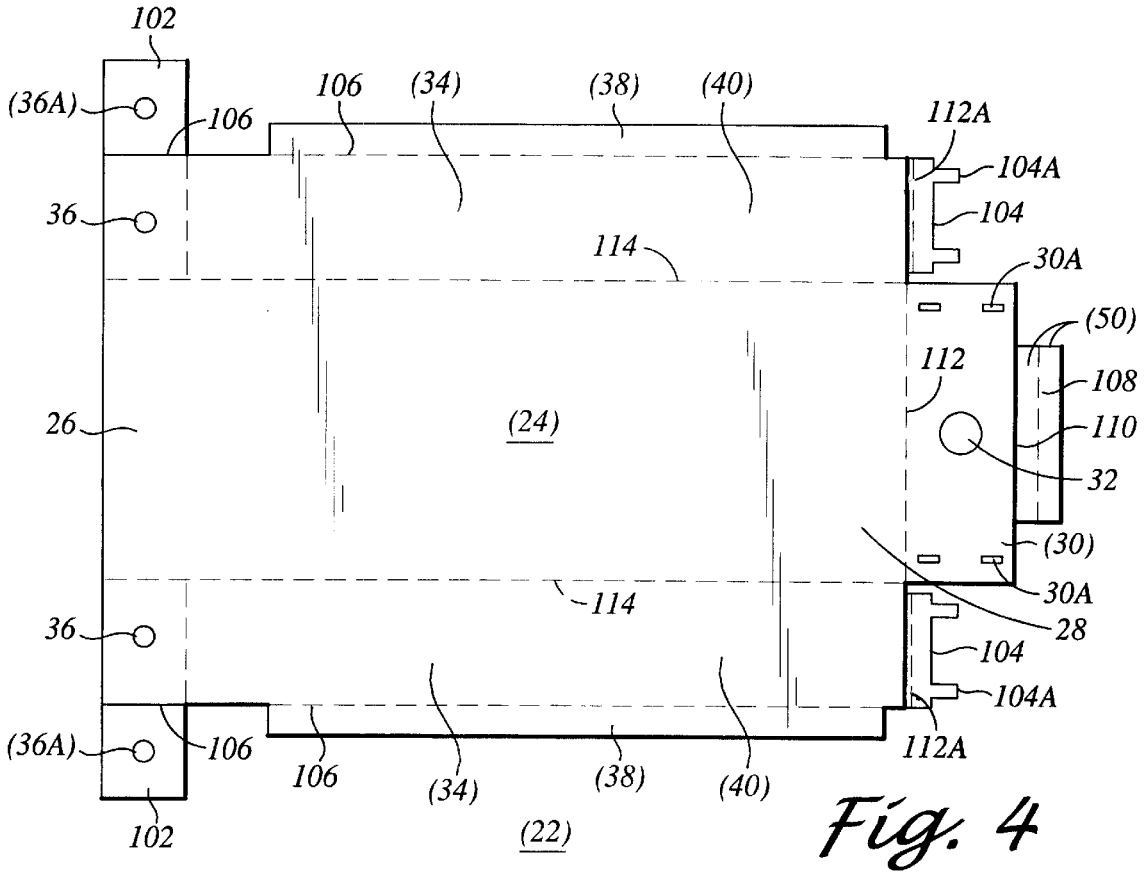
FIG. 4 is top plan view of a flat pattern of the sheet metal base of the jack of FIG. 1.

Referring now to FIG. 4, the base 22 is preferably formed from a piece of sheet metal having a flat pattern defining the areas of the rectangular bottom (24) and the respective rear flange (30), side flanges (34). The pattern includes additional flange areas for forming the increased upper portion (38) of the side flanges, additional tabs 102 for reinforcing the areas around the apertures (36, 36A) in the side flanges, a reinforcing tab 104 at the rearward end of the side flanges, and two tabs (50) for reinforcing the rear flange, all extending outward from the rectangular bottom. The entire base can be formed from a single piece of sheet metal that is stamped to form the apertures and the periphery defined by the flat pattern.

The flat pattern of the base 22 can include one or more optional locking tabs 104A that extend from the reinforcing tabs 104 (at the rear of the side flanges) that can be inserted into optional corresponding slots 30A in the rear flange (30). After the flanges are folded and formed as detailed below, the locking tabs can be inserted through the slots and folded over to lock the corners of the rear and side flanges of the base.

The base is further formed by progressive folds of the stamped flat pattern, having first folds along 106 at the upper edge of the side flanges folded inward 180 degrees thereby providing a double thickness of sheet metal around the apertures 36 near the forward end of each side flange and forming a double thickness along the upper portion 38 of the side flange whereby the longitudinal recess 40 is provided by the single thickness along the lower portion of the side flange.

The outer two tabs (50) at the rear flange of the base are each folded along 108 and 110 inward 90 degrees to form the upper edge 50 of the rear flange. The base of the rear flange is folded along 112 inward 90 degrees to form the rear flange 30, and along 112A (a metal thickness rearward from fold 112) to form the reinforcing tabs 104 at the rearward end of the side flanges (for reinforcing the rear flange.)

The base of the side flanges are then folded along 114 upward 90 degrees to form the side flanges 34 and the reinforcing tabs 104 to enclose the rear flange to form the base 22. (The optional locking tabs 104A can then be folded 90 degrees inward and inserted through the slots 30A, and folded another 90 degrees to further lock the rear corners, without the need for welding.)

Figure 5:
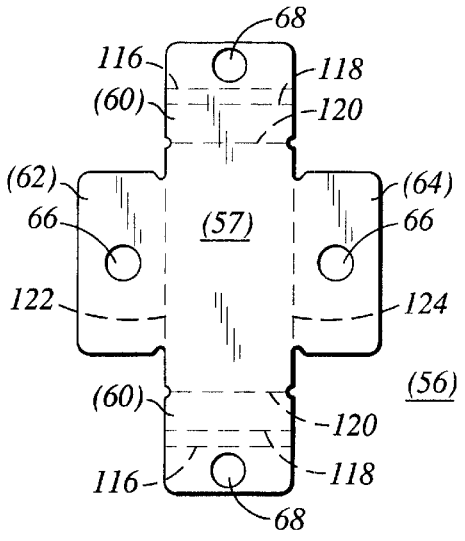
FIG. 5 is a top plan view of a flat pattern of the sheet metal sliding block of FIG. 2.

Referring now to FIG. 5, the sliding block (56) is preferably formed from a piece of 0.188-sheet steel having a flat pattern defining the areas of the rectangular bottom (57) and the respective forward flange (62), rearward flange (64), and side flanges(58) extending outward from the rectangular bottom. The entire block can be formed from a single piece of sheet metal that is stamped to form the apertures 66 and 68 and the periphery defined by the flat pattern. The apertures are suitably threaded to match the threads of the actuator shaft 42.

The block is further formed by progressive folds of the stamped flat pattern, having first folds along 116 at the side flanges with the upper portion folded downward 90 degrees, then the lower portion is defined by folds along 118 of 90 degrees upward, and the side flange is fully formed by another 90 degree fold upward along line 120. The forward flange (62) is then folder along line 122 upward 90 degrees, and the rear flange (64) is folded along 124 upward 90 degrees to complete the block.

Figure 6:
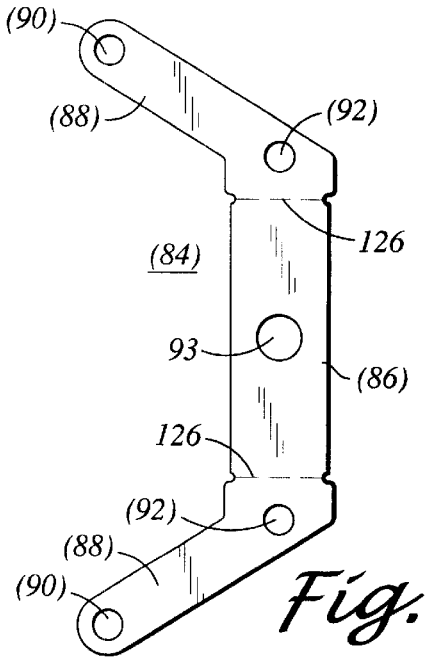
FIG. 6 is a top plan view of a flat pattern of the sheet metal lifting pad of FIG. 1.

Referring to FIG. 6, the lifting pad (84) is similarly formed from a piece of 0.188-inch sheet steel having a flat pattern defining the areas of upper rectangular plate (86) and the respective lever arms (88). The flat pattern includes the respective apertures formed in the upper plate and the upper ends (92) and lower ends (90) of the lever arms. The entire lifting pad can be formed from a single piece of sheet metal that is stamped to form the apertures and the periphery defined by the flat pattern. The threads (for the shaft of the screw-out saddle) are tapped into the central aperture, and folds along 126, 90 degrees downward, fully form the lifting pad.

The various flat patterns may incorporate allowances for bend radii, corner termination apertures and other metal forming techniques, and some hammering to finalize the configuration. The other components can be formed very economically, especially in large quantities, from stamped and folded sheet metal and can be fully assembled without the need for machining and welding.

Power Unit/With Slide Forward Bridge

Figure 7A:
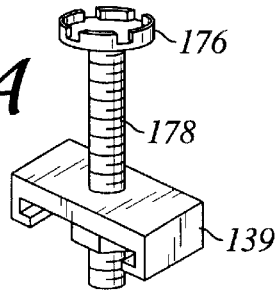
FIG. 7A a perspective view of a lift bridge, exploded over the forward ends of the lift arms of the power unit of FIG. 7.
Figure 8:
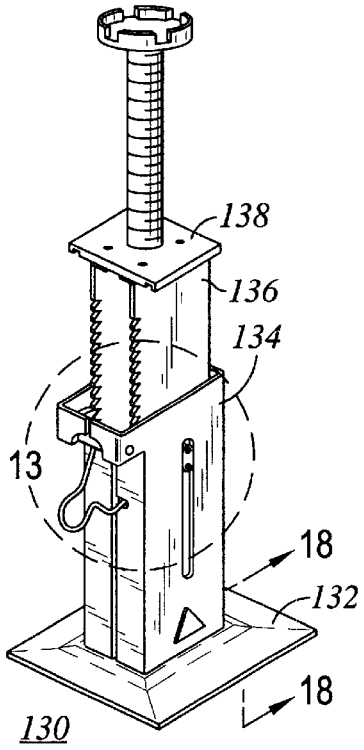
FIG. 8 is a perspective view of an economical jack stand in an elevated position (and relatively positioned to be loaded into the base of the power unit of FIG. 7)
Figure 7:
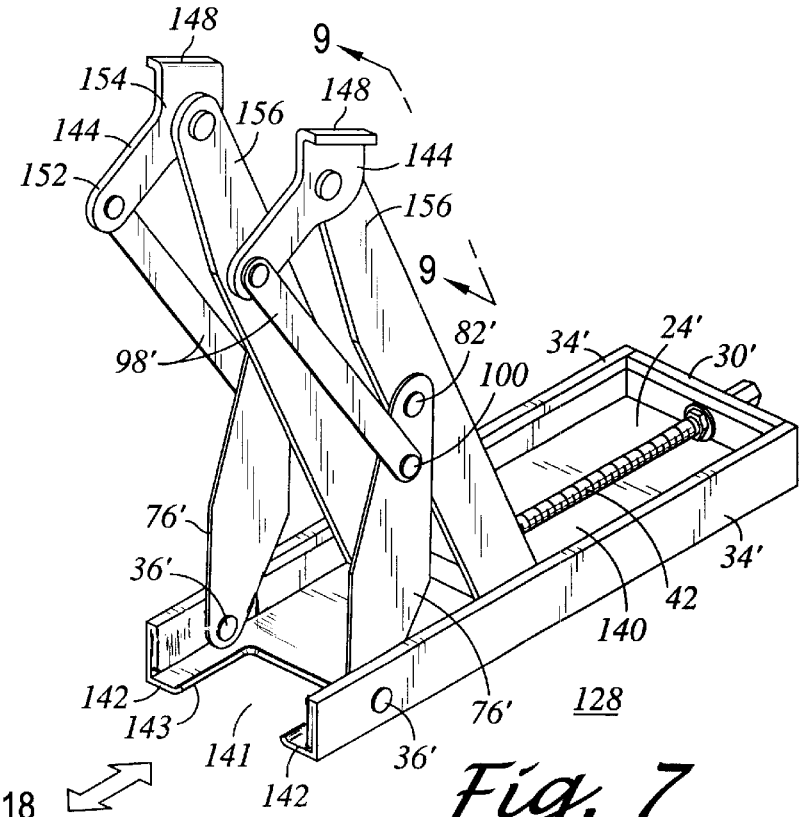
FIG. 7 is a perspective view (similar to FIG. 1), of an economical power unit.
Figure 12:
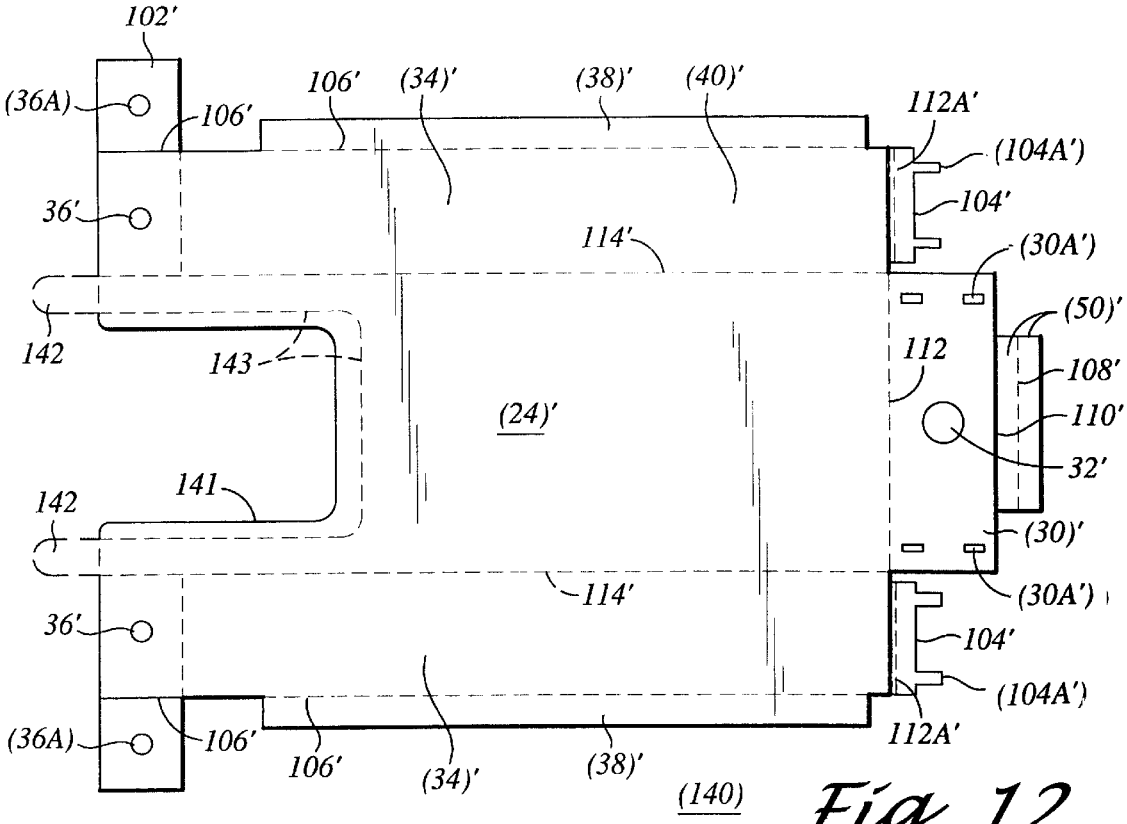
FIG. 12. is a top plan view of a flat pattern of a sheet metal base of the power unit of FIG. 7 (similar to the flat pattern of FIG. 3, except having a forward opening for receiving the jack stand of FIG. 8)
Figure 19:
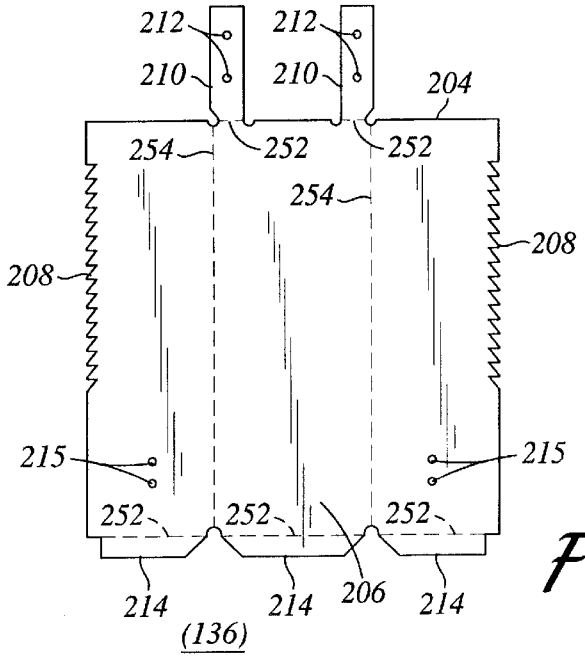
FIG. 19 is a top plan view of a flat pattern of a telescopic ratchet toothed shaft of the jack stand of FIG. 8.
Figure 13:
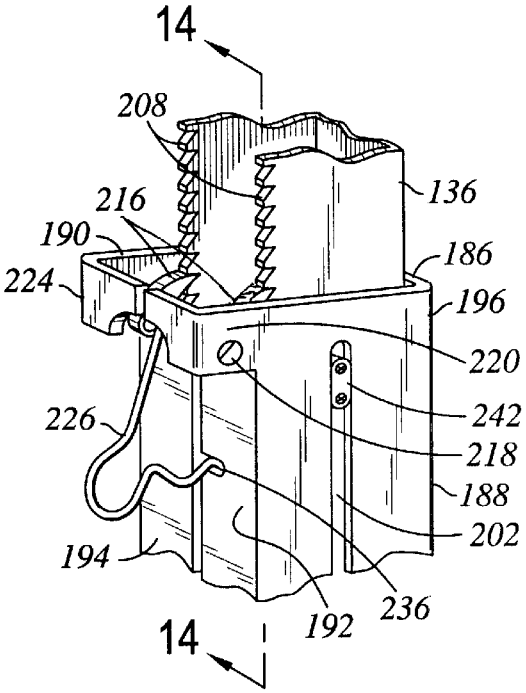
FIG. 13 is an enlarged perspective view of the ratchet shaft and pawl of the jack stand enclosed within 13—13 of FIG. 8.

Referring now to FIGS. 7–8 and 12, an embodiment of an economical power unit 128 is adapted for use with an economical jack stand 130. The jack stand (see FIG. 8) has a base plate 132 with a housing 134 extending upward from the base plate and having a ratchet shaft 136 telescoped within the housing, with a lift collar 138 at the upper end of the shaft. The power unit has many components, similar to the components of the trunk jack 20, fabricated without machining or welding and is similarly assembled without the need for welding (as previously described in terms of FIGS. 1–6). After the power unit has been used to place the jack stand(s), the power unit can additionally be adapted, with a lift bridge 139 (see FIG. 7A), for use as a conventional jack as discussed later in detail.

The power unit 128 has a base 140 (similar to base 22 of FIGS. 1 and 4) having a rectangular bottom 24', the rear flange 30' with central aperture 32', the side flanges 34' with reinforced apertures 36' and increased thickness 38' along the upper portion thereof providing the longitudinal recess 40' formed along the lower portion on the inner surfaces of each side flange, as previously discussed. However, the base of the power unit includes a "U" shaped opening 141 in the forward end thereof for receiving the jack stand 130, by sliding over the base plate 132 and engaging the bottom of the housing 134 within the opening. The U-opening includes a pair of optional lead-in tabs 142 inclined upward (for sliding over the base plate), and a lip 143 flared upward (see FIG. 12) to facilitate engagement with the jack stand.

In a basic embodiment, the power unit utilizes the same lift arms (70), connecting arms 76', and connecting links 98' as previously described (in terms of the jack 20). However, the power unit must have an opening at the forward ends of the lift arms to receive and engage the lift collar 138 of the jack stand 130; therefore, a pair of separated leveling pads 144 are utilized (rather than the lifting pad 84, utilized by the jack) at the forward ends of the lift arms.

Figure 9:
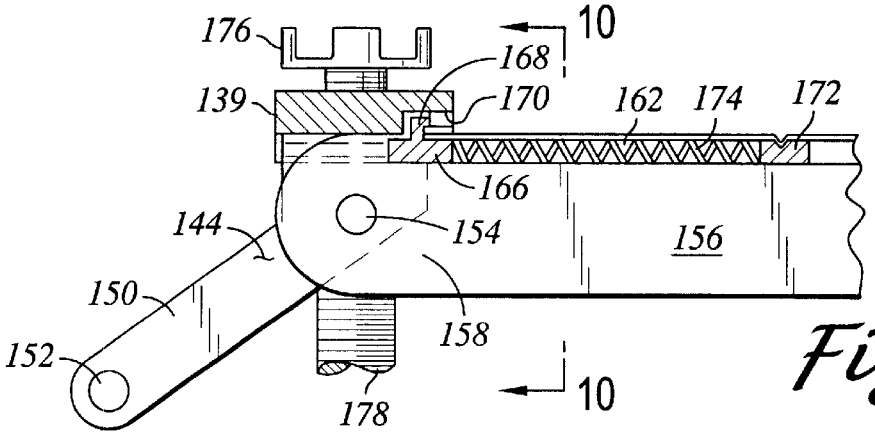
FIG. 9 is a sectional view taken generally along 9—9 of FIG. 7, (however; with the lift arm in the lowered position) showing a track in the lift arm for slideably retaining the lift bridge and with the lift bridge in the slide forward position.
Figure 10:
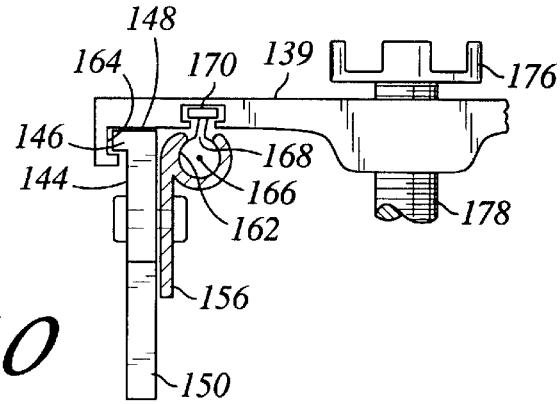
FIG. 10 is a partial sectional view taken along 10—10 of FIG. 9.
Figure 11:
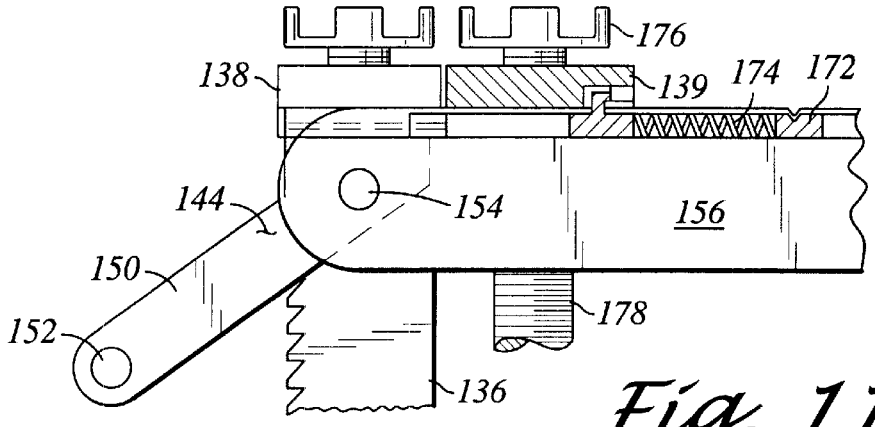
FIG. 11 is a sectional view, similar to FIG. 9, showing a jack stand engaged with the lift arm, and the bridge forced rearward away from the forward ends of the lift arm by the jack stand.

Referring also to FIGS. 9–11, a preferred embodiment is shown having lift arms 156 that include an upper track to slideably retain the lift bridge 139 on the lift arm. The lift arms are shown in the horizontal position, and the upper tracks uniquely cooperate with the respective leveling pad 144 of the lift arms to retain and transfer the lift bridge. The leveling pads are suitably formed from a rectangular plate of about 0.188-inch steel, in a vertical orientation having the upper edge extruded, folded or wiped to form an outward flange 146 and provide a smooth upper surface 148 about 0.250-inch wide. The upper surface of the leveling pad is used to engage the lift collar 138 of the jack stand (see FIG. 11), or to engage the lower surface of the bridge 139 (see FIGS. 9 and 10). Each leveling pad includes a lever arm 150 extending forward and downward, at about 30 degrees, having a lower end 152, and an upper end 154 pivotal attached to the forward end of the lift arm. The pair of connecting link 98' (see FIG. 7) are each pivotally connected at one end to the lower end 152 of the lever arm and pivotally connected at the other end to connecting point 100' on the respective connecting arms 76', as previously discussed.

The power unit is operated (same as jack 20, see FIG. 2) by the screw threaded actuator shaft 42 and the reinforcing plate 48, and the sliding block 56 that slides along the bottom of the base 140. As previously discussed, the block is preferable formed from sheet metal that is stamped into a flat pattern and folded into the desired configuration (see FIG. 5).

In this preferred embodiment, the power unit has the pair of lift arms 156 acting in parallel having forward ends 158 and rearward ends 160, with the rearward ends pivotally attached to the respective side flanges 58 of the sliding block 56. Each lift arm further includes the upper track provided by a longitudinal recessed channel 162 formed in the upper edge thereof for slideably retaining the lift bridge 139. The channels can suitably be formed into a substantially circular (see FIG. 10) "C" or "U" shaped cross section. The lift arms are suitably formed from 0.125-inch steel about 1 inch high (after forming the channel) and are about 13 inches in length. The lift arm, including the channels, can be formed at the steel mill by folding and forming the upper edge, or extruding the upper edge into the desired shape in long strips and cutting them to the desired length. The cross section of the lift arm 156 are symmetrical and the same formed lift arm stock can be use for the left lift arm and reversed for the right lift arm. The lift arms can be efficiently and economically produced in large quantities and received directly from the mill, ready for assembly.

The lift bridge 139 is primarily a rectangular plate that is adapted to be positioned on the forward ends 158 of the lift arms 156. The forward ends of the lift arms include the leveling pads 144, each having the flange 146 and the upper surface 148 adapted to engage the lift collar 138 of the jack stand, and are also adapted to engage the flange channels 164 in the inner sides of the bridge, when the bridge is properly positioned on the forward ends of the lift arms. The lift bridge 139 is efficiently produced by a metallic casting incorporating the desired recesses and flanges, as well as any other desired features, i.e. a central aperture therein with suitable reinforcing boss, or strengthening ribs or gussets for added strength or for other specific applications.

The recessed channels 162 of the guide tracks each have a suitable shape and internal surface to retain a follower member 166. As shown in FIG. 10, the follower member has a suitable inverted "T" cross section retained within the "C" shaped recessed channels 162, and has a guide pin 168 with a "T" shaped upper end, extending upward from the opening of the channel and is adapted to traverse along the upper surface of the lift arm. The bridge 139 further includes a pair of recessed slots 170 in the rearward bottom thereof adapted to engage the guide pins, to facilitate movement of the lift bridge along the track from the forward position to the displaced position. The inverted "T" shape of the follower member and the "T" shape of the guide pin form a generally "I" shaped cross section of the follower member to suitable interconnect the bridge within the recessed channel.

The bridge 139 is retained by the engagement of the guide pins of the follower member 166 and the recessed slots 170 whenever the bridge is displaced rearward along the lift arm. When the bridge is transferred to the forward end of the lift arms, the channel flanges 164 of the bridge slide over the flanges 146 of the leveling pads 144 until the bridge is fully positioned thereon. This follower member, guide pin, recessed slot, retention means are designed to operate with loose tolerances, and is rugged and reliable in the work environment. With the foregoing components, the lift bridge remains integral with the lift arms and functions quite smoothly from the forward position to the rearward displaced position on the lift arms of the power unit.

The length of the longitudinal recessed channel 162 of the lift arm 156 is defined by a plug 172 that is adapted to fit snugly within the recessed channel. The plug is first inserted into the forward end of the recessed channel and pushed to the desired position, then the exterior of the track is staked (i.e. with a hammer and punch) at, or slightly rearward of, the plug to fix it into position within the channel. The follower member 166 is thereby limited to travel along the lift arm between the forward end thereof and the displaced position defined by the position of the plug.

Referring particularly to FIGS. 9 and 11, a more preferred embodiment is described wherein the recessed channels 162 further include biasing means, shown as compression springs 174 to urge the respective follower members 166 to the forward ends of the channels of the lift arms. Thus, the lift bridge 139 is automatically urged to the forward ends of the lift arm; and conversely, a force on the forward end of the lift bridge pushes the respective follower member rearward within the recessed channel to compress the spring. The compression spring is adapted to provide sufficient force to position the bridge at the forward ends of the lift arms (when the lift arms are in a generally horizontal orientation), and further adapted to be readily compressible by the routine engagement of the forward end of the bridge with the housing or lifting pad of a jack stand 130 within the forward end of the frame. The springs 174 are suitably inserted into the channels 162 at the forwards end thereof, prior to insertion of the respective follower member 166. The spring and follower member are suitable retained at the forward end of the lift arms by the engagement of guide pin with the bridge, but can be further contained by blocking the forward end of the recessed channel with a suitable plug, crimp or other restriction.

The spring 174 is retained within the recessed channels 162 and automatically expanded to the full span of the channel along with the follower members 166, whenever there is no jack stand 130 positioned within the frame of the power unit, as in FIG. 9. The power unit, with the automatic slide forward bridge 139 positioned at the forward ends of the lift arms 156, is thus automatically converted for use as a load-lifting jack.

The springs 172 are shown-compressed within the channels in FIG. 11, by the engagement of the jack stand. The power unit, with the automatic slide forward bridge forced rearward by the engagement of a jack stand, is thus automatically converted for use with the jack stand.

The lift bridge 139 further features a screw-out saddle 176 that includes a threaded shaft 178 about 0.5-inch in diameter and extending downward about 4 to 6 inches, and engaged within a threaded aperture of the bridge. The screw-out saddle is utilized to adjust the distance between the bridge and the object to be lifted for maximum lift and utility of the power unit.

Referring now to FIG. 12, the base 140 is preferably stamped from a piece of sheet steel having a flat pattern defining the areas of the rectangular bottom (24') including the U shaped opening 141 and the lip 143 and the respective rear flange (30') and side flanges (34'). The pattern includes additional flange areas for forming the increased upper portion (38') of the side flanges, additional tabs 102' for reinforcing the areas around the apertures (36', 36A') in the side flanges, a reinforcing tab 104' at the rearward end of the side flanges, and two tabs (50') for reinforcing the rear flange, all extending outward from the rectangular bottom. The entire base can be formed from a single piece of sheet metal that is stamped to form the apertures and the periphery defined by the flat pattern.

The flat pattern of the base (140) can include one or more optional locking tabs 104A' that extend from the reinforcing tabs 104' (at the rear of the side flanges) that can be inserted into optional corresponding slots (30A') in the rear flange (30'). After the flanges are folded and formed as detailed below, the locking tabs can be inserted through the slots and folded over, to lock the corners of the rear and side flanges of the base.

The base is further formed by progressive folds of the stamped flat pattern, having first folds along 106 at the upper edge of the side flanges folded inward 180 degrees thereby providing a double thickness of sheet metal around the apertures 36 near the forward end of each side flange and forming a double thickness along the upper portion 38 of the side flange whereby the longitudinal recess 40 is provided by the single thickness along the lower portion of the side flange.

The outer two tabs (50) at the rear flange of the base are each folded along 108 and 110 inward 90 degrees to form the upper edge 50 of the rear flange. The sheet is folded along 112 inward 90 degrees to form the rear flange 30, and along 112A (a metal thickness rearward from fold 112) to form the reinforcing tabs 104 at the rearward end of the side flanges (for reinforcing the rear flange.)

The base of the side flanges are then folded along 114' inward (upward) 90 degrees to form the side flanges 34 and the reinforcing tabs 104' and locking tabs 104A' to enclose the rear flange, to form the base 140 without the need for welding.

Referring again to FIG. 5, as previously discussed, the sliding block (56) is preferably formed from a piece of 0.188-inch sheet metal having a flat pattern defining the areas of rectangular bottom (57) and the respective forward flange (62), rearward flange (64), and side flanges (58) extending outward from the rectangular bottom. The entire block can be formed from a single piece of sheet metal that is stamped to form the apertures 66 and 68 and the periphery defined by the flat pattern. The apertures are preferably threaded to match the threads of the actuator shaft.

The block is further formed by progressive folds of the stamped flat pattern, having first folds along 116 at the side flanges with the upper portion folded downward 90 degrees, then the lower portion is defined by folds along 118 of 90 degrees upward, and the side flange is fully formed by another 90 degree fold upward along line 120. The forward flange (62) is then folder along line 122 upward 90 degrees, and the rear flange (64) is folded along 124 upward 90 degrees to complete the block.

Jack Stand

Referring now to FIGS. 8 and 13–20, an economical jack stand 130 (for use with the power unit 128), is shown that is extremely functional, reliable, durable and safe; and the components thereof can be produced and assembled without machining or welding. The jack stand is typically operated by the power unit 128; however, the jack stand can be utilized separately, placed and operated by hand, to support a load that has already been elevated by a conventional jack or other means.

The jack stand 130, and many components thereof have been previously described in reference to the power unit 128, and includes the rectangular base plate 132 having the tubular housing 134 extending vertically from the base plate.

The base plate 132 (see particularly FIGS. 16–18) is suitable a rectangular square about 6 inches by 6 inches of 0.125-inch steel plate that is stamped to include about four slots 180 therein (adapted to receive tabs 182 from the lower ends of the tubular housing). The peripheral area 183 of the base plate is flat, and the central area of the base plate (inscribed by the slots) is flat to support the tubular housing, and the central area is contoured upward about 0.125-inch through a formed area 184 to provide clearance for the tabs of the tubular housing to be folder under the base plate.

The tubular housing 134 (see particularly FIGS. 17 and 20) extends about six to eight inches from the base plate and is preferably rectangular in cross section having a rear side 186, a left side 188, a right side 190, a left front half 192, a right front half 194, with each side about 2 inches wide. The housing has an upper end 196 and a lower end 198. The lower ends of the respective sides include the extended tabs 182, adapted to be inserted into the slots 180 and folded under the base plate 132, for attaching the housing to the base plate. The lower ends of the left side 188 and right side 190 of the housing each further includes a lateral protrusion 200 formed initially by a stamped slit of about 0.75-inch and progressively pressed outward about 0.125-inch to provided a suitable channel (with the base plate 132) for slideable engagement with the lip of the U shaped opening 141 of the base of the power unit 128. The left and right sides of the housing further include vertical slots 202, in the centers thereof, which act as stabilizing guides for the ratchet shaft 136, to be described later in more detail. The housing is suitably formed from 0.125-inch steel that is progressively stamped, formed and folded into the desired configuration.

The ratchet shaft 136 (see particularly FIGS. 19 and 20) is preferably a "U" shaped shaft having an upper end 204, a lower end 206, with upward-inclined-ratchet teeth 208 formed on the forward edges thereof. The shaft is suitably about seven inches long and formed of 0.188-inch steel with equal sides (about 1.88 inches) adapted to be telescopically inserted within the housing 134, and is vertically extendable and retractable within the housing. The upper end 204 of the ratchet shaft includes upper tabs 210 that are folded inward 90 degrees to provide an upper surface, and the upper tabs include four apertures 212, for attaching the lift collar 138 to the upper end-of the shaft. The lower end 206 of the sides includes optional tabs 214 which are folded inward to provide additional strength and rigidity to the lower end of the shaft. The left and right sides of the shaft also include stamped and threaded apertures 215 that, upon assembly, are aligned with the vertical slots 202 of the housing and are adapted to retain stabilizing lugs 242, to be later described in more detail.

The tubular (square) housing 134 and ("U") ratchet shaft 136 are preferably generally rectangular in cross-section as shown and have strength and self aligning advantages; however, the components could also be formed having a cylindrical housing and a semi-cylindrical shaft and a generally circular cross section, that can similarly be readily stamped, rolled, and formed into an economical jack stand of the present invention.

The height of the ratchet shaft 136 is locked in position within the housing by a pair of pawls 216 that are interconnected on a D-pin 218 and each pawl is adapted to be engagable with a respective tooth 208 of the shaft. Each pawl is somewhat "claw" shaped having a base with a diameter of about 0.50-inch and tapering about one inch to a curved, sharp distal tip. The D-pin has a "D" shaped cross-section that mates with corresponding lateral "D" shaped apertures in the pawls, to fix the orientation of the pawls on the D-pin. The D-pin suitably has a major diameter of about 0.375-inch of hardened steel and is about 2.25 inches in length. Each pawl is suitably stamped from 0.25-inch steel plate. The pawls are aligned on the pin adjacent the ratchet teeth and suitably fixed laterally on the D-pin with setscrews, or preferably swedged, staked or are otherwise bonded to the pin. The upper end of the housing includes a pair of vertical flanges 220 extended forward about one inch and having apertures 222 therein to pivotally support the D-pin adjacent to the ratchet shaft. The flanges are further extended and folded inward to provide a front portion 224 to generally enclose the D-pin and pawls.

The engagement and disengagement of the pawls 216 with the ratchet teeth 208 are controlled by an actuating spring 226. The upper end 228 of the actuating spring is formed into a "D" shape and attached to (wrapped around) the D pin 218, and a generally vertical central portion 230 provides the lever handle to control the rotation of the D-pin and pawls. The lower end of the actuating spring in bent generally horizontal (forming a finger pull loop) and includes a first position indention 232 and a second position indention 234. The actuating spring is suitable formed of 0.125-inch diameter spring steel, or flat spring steel about 0.125-inch by about 0.063-inch, (about six inches long) and contoured generally into the above described shape with a handle central portion 230 about three inches in length.

A front half (shown in the right front half 194) of the housing 143 includes a slotted opening 236 adapted to receive the lower end of the actuating spring 226. The slot is off center to provide any needed clearance with a screw out saddle that may be extended downward within the center of the ratchet shaft 136. The upper end 228 of the actuating spring 226 is similarly positioned on the right side of the D-pin (near the right pawl 216) to vertically align the actuating spring in the slotted opening 236.

Figure 14:
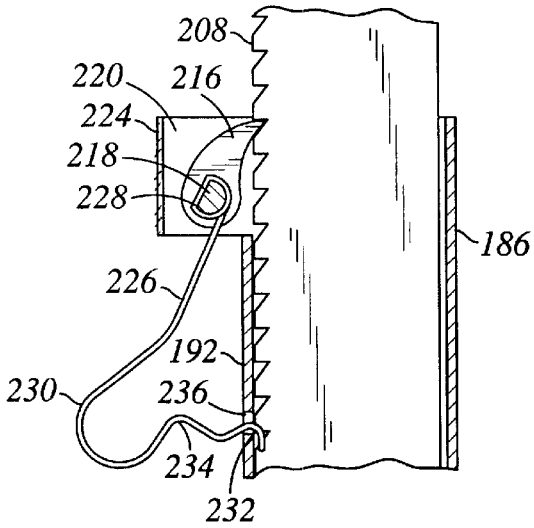
FIG. 14 is a sectional view taken along 14—14 of FIG. 13; illustrating the spring positioned so that the pawl is engaged with the ratchet teeth of the shaft.

As shown in FIG. 14, when the handle portion 230 of the actuating spring 226 is pulled out, the first position indention 232 is engaged with the slotted opening 236 of the housing, to provide inward (clockwise) rotational torque on the pin 218, and thus the pawls 216 are each engaged with one of the respective ratchet teeth 208. In typical ratchet movement, as the ratchet shaft is extended, the inclined upper surface of the next ratchet tooth 208 wedges the underside of the pawl (slightly counter-clockwise) and slides upward past the pawl, and the torque of the spring engages the pawl back onto the "next" tooth, etc. However, the lower surface of the "next" tooth is flat (and indented) and can only act on the upper side of the pawl, and any downward force on the upper side of the pawl tends to lock the pawl into the base of the "next" tooth; and thus prevents any downward movement of the shaft. When the jack stand is raised to the desired height, each pawl is engaged under the adjacent "next" ratchet teeth to securely and safely support the load, and the power unit 128 can be lowered and removed.

Figure 15:
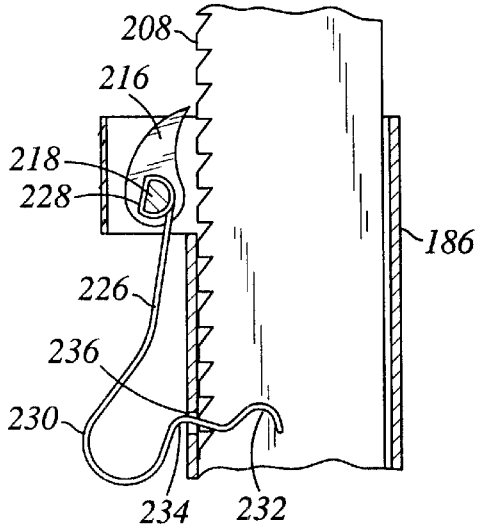
FIG. 15 is a view similar to FIG. 14 illustrating the spring in the released position and the pawl disengaged from the ratchet teeth, to lower the shaft.
Figure 17:
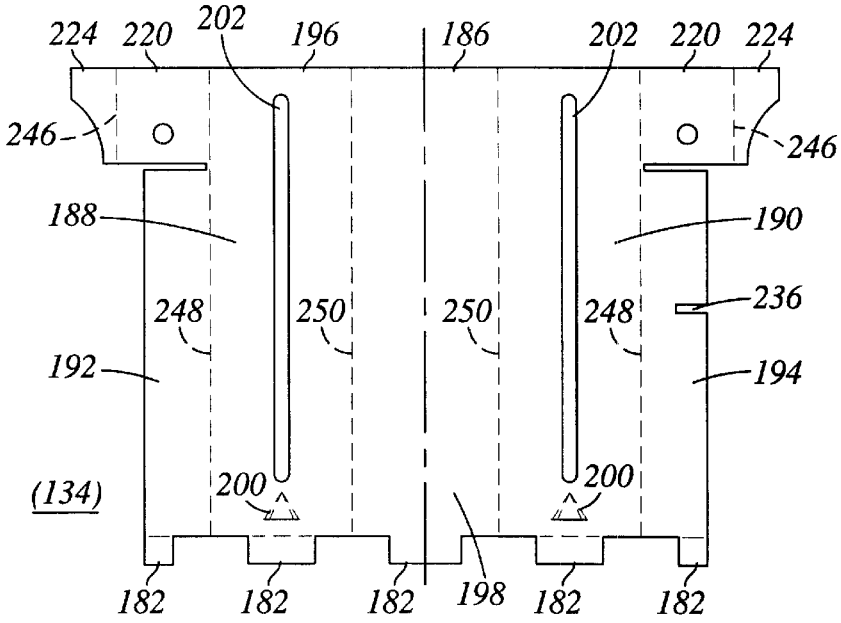
FIG. 17 is a top plan view of a flat pattern of a sheet metal housing of the jack stand of FIG. 8.
Figure 16:
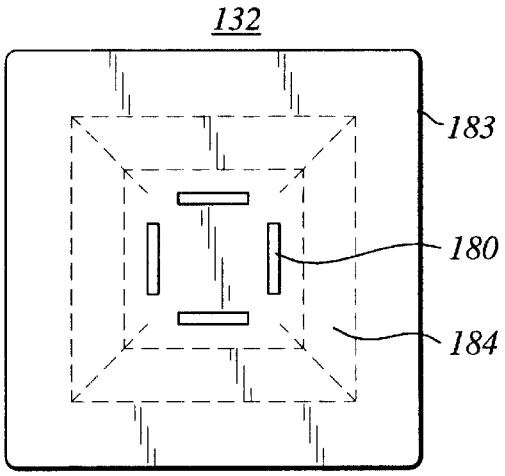
FIG. 16 is a top plan view of a flat pattern view of the base plate of the jack stand of FIG. 8.
Figure 18:
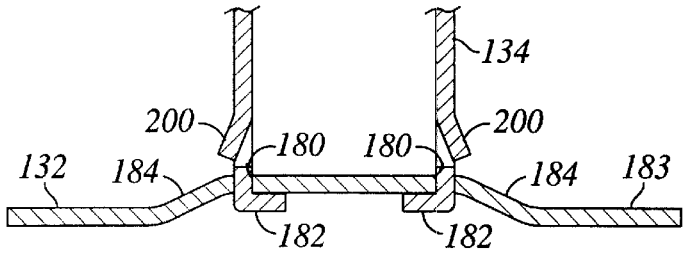
FIG. 18 is a sectional view taken along 18—18 of FIG. 8, showing the jack stand housing attached to the base plate.
Figure 20:
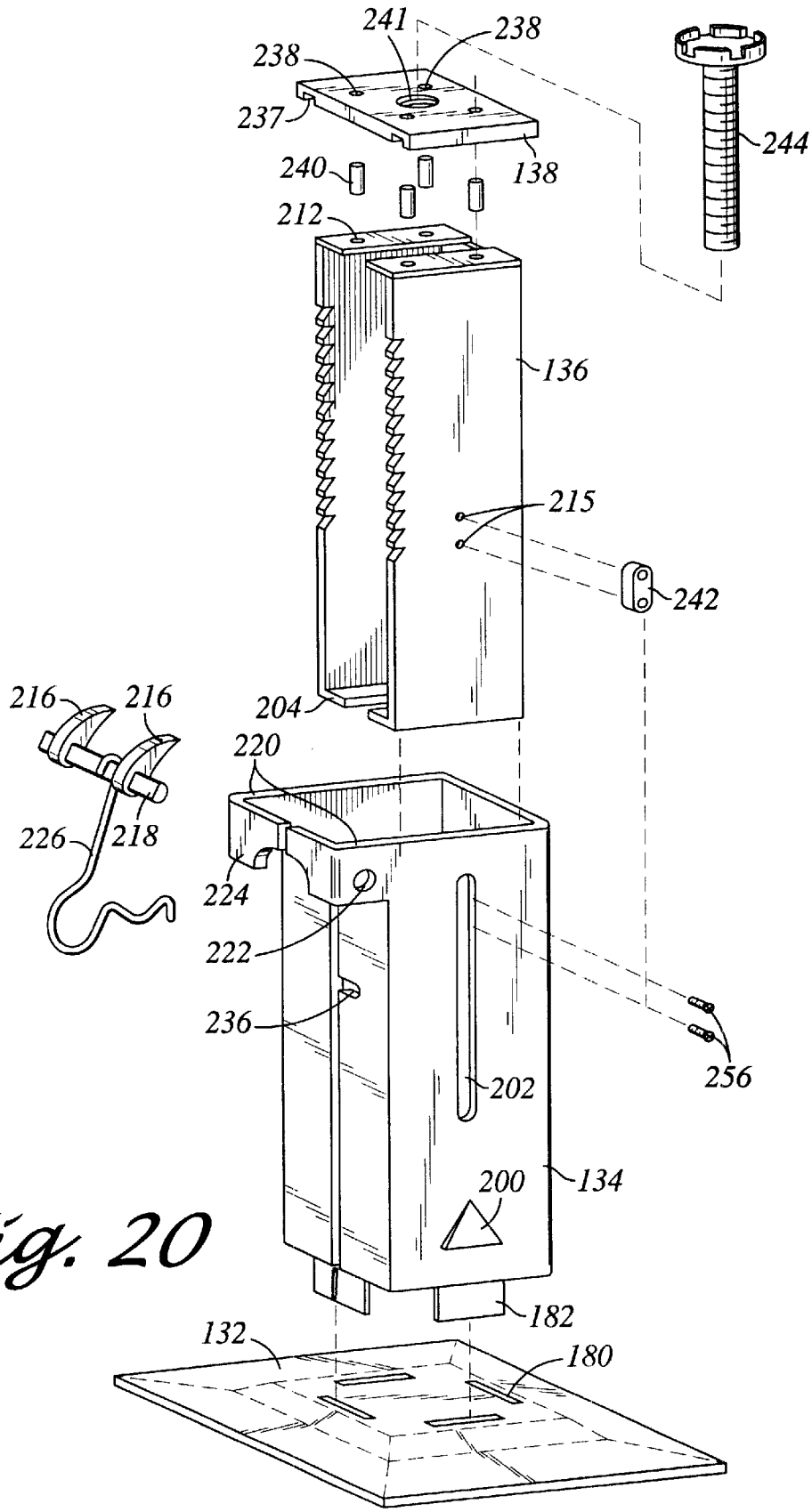
FIG. 20 is an exploded perspective view illustrating the components and assembly of the jack stand of FIG. 8.

As shown in FIG. 15, to lower the ratchet shaft, the handle portion 230 of the actuating spring 226 is pushed inward, and the second position indention 234 is engaged with the slotted opening 236 of the housing to provide outward (counter-clockwise) rotational torque on the pin 218, and thus the pawls 216 are disengaged from the ratchet teeth 208. It should be noted that, if there is a downward load on the ratchet shaft, the torque of the actuating spring is insufficient to disengage the pawls and the ratchet shaft remains locked within the housing until the load is released (by engagement of the power unit 128 and slightly raising the jack stand), then the torque of the actuating spring releases the pawls and the load and jack stand can be lowered by the power unit.

The lift collar 138 is suitable a rectangular plate having a pair of channels 237 in the lower surface thereof adapted to engage the leveling pads 144 of the power unit 128. The lift collar has four apertures 238 therein aligned with the apertures 212 in the upper surface of the ratchet shaft 136, for attaching the lift collar with suitable headless rivets 240. The lift collar preferably includes a central aperture 241 adapted to receive a screw-out saddle 244. The lift collar is suitably about 3.5 inches by 2.0 inches and formed of 0.250-inch steel plate, or can also be efficiently cast in the above dimensions to include the channels and the central aperture.

The screw-out saddle 244 is similar to those previously described, having a threaded shaft about 0.50-inch in diameter and about four six inches in length. The screw-out saddle is utilized to adjust the distance between the lift collar and the object to be lifted, for maximum lift and utility of the jack stand.

Referring again to FIGS. 16–20, the jack stand is economically produced by first stamping the contoured base plate 132 (see FIG. 16).

The tubular housing 134 is formed from a piece of sheet metal having a flat pattern (see FIG. 17) defining the area of rear side (186) in the center thereof, with the area of the left side (188) and right side (190) extending outward therefrom, and the respective areas of one half of the front sides (192, 194), flanges (220, 224), and tabs 182 each extending outward from the respective side. The periphery of the flat pattern is stamped, along with the lateral protrusions 200 and the vertical slots 202 and apertures 222. The flat pattern (134) is next folded 90 degrees inward along lines 246, then along lines 248, and also along lines 250 to form the tubular housing. The metal is stamped and formed with conventional tooling and metal forming techniques, and can be suitably formed with various sequences of the folds.

The tabs 182 of the housing 134 are fully inserted into the corresponding slots 180 in the base plate 132 (see FIG. 20) and folded over (see FIG. 18) to firmly secure the housing to the base plate.

The pawls 216, D-pin 218 and actuating spring 226 (see FIG. 20) are sub-assembled, with one pawl (i.e. the right) and the actuating spring fixedly positioned on the right side of D-pin, and with the other pawl (i.e. the left) slideably on (but not fixed on) the D-pin. The left end of the D-pin, with the slideable pawl inward, is fed under the front portion 224 of the housing and inserted through the left aperture 222 of the left flange 220 of the housing 134, and the other end of the D-pin is maneuvered into the right aperture of the corresponding right flange of the housing. The D-pin is then aligned to position the fixed right pawl against the inner right flange 220 (for proper alignment with the respective ratchet teeth 208 of the U shaft to be inserted in the housing) and the slideable pawl (the left) is then positioned close to the inner left flange 220 (for proper alignment with the other ratchet teeth of the shaft), and is fixed in position on the D-pin. The lower end of the actuating spring is then inserted into the opening 236 of the housing, and pushed inward to the $2^{nd}$ position indentation 234 to complete the assembly of the tubular housing.

The U shaped ratchet shaft 136 is stamped into the flat pattern (see FIG. 19) and is then folded inward 90 degrees along lines 252 to provide the top and bottom surfaces, then folded inward 90 degrees along lines 254 to form the respective sides of the shaft.

As previously discussed, the lift collar 138 is attached to the upper surface of the ratchet shaft (see FIG. 20) by a set of four headless rivets 240 that are inserted within the respective aligned apertures 212 of the ratchet shaft and apertures 238 of the lift collar. The rivets (and apertures) are about 0.125-inch in diameter and are about 0.50-inch in length (exceeding the thickness of the combined components) and are then compressed (hot upset process) to expand within the apertures, and securely bond the lift collar to the upper surface of the shaft. The screw-out saddle 244 in then inserted into the lift collar to complete the assembly of the ratchet shaft.

The assembled ratchet shaft 136 (with lift collar 138) is then inserted into the housing 134 and nested in the bottom of the housing. A stabilizing lug 242 is attached through the vertical slot 202 in each side of the tubular housing, to the threaded apertures 215 in each side of the ratchet shaft, with suitable fasteners 256. The lugs are each about 0.25-inch thick by 0.75-inch high by 0.25-inch wide, and are adapted to slide within the full range of the slots to retain and stabilize the ratchet shaft within the housing.

In use by a consumer, the power unit 128 and jack stand 130 are engaged and positioned at a desired lift location under an automobile (or other object to be lifted or pushed). The actuator shaft 42 and block 57 are advanced to pivot the lift arms and raise the leveling pads 144 under the lift collar 138. This extends the telescopic ratchet shaft 136 from within the housing 134 of the jack stand to raise the automobile corner to the desired height. The power unit can then be lowered and removed, leaving the extended ratchet shaft locked, by a releasable pawls 216, to the housing of the jack stand, safely supporting the elevated corner of the automobile. (The power unit can now be used to position another jack stand 130, or used with the bridge 139 as a jack to raise another corner of an automobile.) To lower the automobile, the power unit is re-positioned and re-engaged with the elevated jack stand. The power unit is actuated so that the leveling pads are raised up under the lift collar of the jack stand to support the load and relieve the force on the ratchet shaft. The actuating spring 226 of the jack stand is pushed in to release the pawls from the ratchet shaft, and the actuator 42 and block are retracted to lower the leveling pads of the power unit. As the power unit is lowered, the ratchet shaft is smoothly telescoped back within the housing until the jack stand is free from the automobile. The jack stand and the power unit can now be removed.

While specific embodiments and examples of the present invention have been illustrated and described herein, it is realized that modifications and changes will occur to those skilled in the art. It is therefore to be understood that the appended claims are intended to cover all such modifications and changes as fall within the spirit and scope of the invention.

What is claimed is:

1. An economical lifting device comprising:

a base having a rectangular bottom with a forward end and a rearward end, a rear flange extending upward from the bottom and having a central aperture therein, and left and right side flanges extending upward from the bottom with each side flange having an aperture near the forward end thereof and having an increased thickness along the upper portion thereof providing a longitudinal recess formed along the lower portion on the inner surface of the flange;

a screw threaded actuator shaft having a distal end and a proximal end extending through the aperture of the rear flange of said base, with the proximal end rotatably retained within the aperture and further adapted to be engageable by an external handle to facilitate rotation of the shaft;

a sliding block having a rectangular bottom, left and right sides slideably retained within the longitudinal recesses of the side flanges of said base, and having a forward end and a rearward end with a central threaded aperture therein for receiving the forward end of said actuator shaft;

a pair of lift arms acting in parallel having forward ends and rearward ends with each rearward end pivotally attached to the respective side of said block;

a pair of connecting arms acting in parallel each having a forward end pivotally attached at the respective aperture near the forward ends of the respective side flange of said base, and having a rearward end pivotally attached at a pivot point on said lift arm, with the pivot point at a distance from the rearward end of said lift arm that is about equal to the length of said connecting arm;

a lifting pad attached to the forward ends of said lift arms and adapted to provide a level lifting platform thereon.

2. The lifting device as in claim 1, wherein said lifting pad comprises an upper rectangular plate oriented horizontally and having a pair of parallel lever arms extending downward and forward from the sides of the plate with each lever arm having an upper end pivotally attached to the forward ends of the lift arms and having a lower end thereof; and a pairs of connecting links each pivotally connected at one end to the lower end of said lever arm and pivotally connected at one end to a point on said connecting arm, so that the lifting pad remains substantially horizontal during movement of said lift arms.

3. The lifting device as in claim 2, wherein said lifting pad has a central threaded aperture therein, and further includes a screw-out saddle having a threaded shaft extending downward therefrom adapted to engage the aperture in said lifting pad.

4. The lifting device as in claim 1, wherein said base is formed from a piece of sheet metal defining the areas of the rectangular bottom and the respective rear flange, side flanges, additional flanges for forming the increased upper portion of the side flanges, additional tabs for reinforcing the areas around the apertures in the side flanges, a reinforcing tab at the rearward end of the side flanges, and tabs for reinforcing the rear flange, all extending from the rectangular bottom.

5. The lifting device as in claim 4, wherein said base is further formed by progressive folds of the piece of sheet metal, having first folds along the upper edge of the side flanges folded inward 180 degrees thereby providing a double thickness of sheet metal around the apertures near the forward end of each side flange and forming a double thickness along the upper portion of the side flange whereby the longitudinal recess is formed by the single thickness along the lower portion of the side flange;

the outer two tabs at the rear flange are each folded inward 90 degrees to form the upper edge of the rear flange;

the base of the rear flange is folded inward 90 degrees to form the rear flange and form the reinforcing tab at the rearward end of the side flanges;

the base of the side flanges are then folded upward 90 degrees to form the side flanges and the reinforcing tabs enclose the rear flange to form the base of said lifting device.

6. The lifting device as in claim 1, wherein said sliding block is formed from a piece of sheet metal having a rectangular bottom, a forward flange extending upward with a threaded central aperture therein, a rearward flange extending upward having a threaded central aperture therein, and side flanges each extending upward having a lower portion adapted to be retained within the longitudinal recess of the side flange of said base and having an indented upper portion with a aperture therein for attachment to said lift arm.

7. The lifting device as in claim 6, wherein said sheet metal has a flat pattern defining the areas of the rectangular bottom and the respective forward flange, rearward flange, and side flanges extending outward from the rectangular bottom.

8. The lifting device as in claim 7, wherein said block is further formed by progressive folds of the stamped flat pattern, having folds along the side flanges with the indented upper portion folded downward 90 degrees, then the extended lower portion is defined by a fold 90 degrees upward, and the side flanges are completed by another 90 degree fold upward along the sides of the rectangular bottom; and the forward flange is formed by a fold 90 degrees upward along the forward end of the rectangular bottom, and the rearward flange is formed by a fold 90 degrees upward along the rearward end of the rectangular bottom.

* * * * *